US006199304B1

(12) United States Patent
Ludemann

(10) Patent No.: US 6,199,304 B1
(45) Date of Patent: Mar. 13, 2001

(54) SOCKLINER

(75) Inventor: John F. Ludemann, Southport, ME (US)

(73) Assignee: Nine West Group, Inc., White Plains, NY (US)

( * ) Notice: Subject to any disclaimer, the term of this patent is extended or adjusted under 35 U.S.C. 154(b) by 0 days.

(21) Appl. No.: 09/314,724

(22) Filed: May 18, 1999

(51) Int. Cl.[7] ..... A43B 13/38
(52) U.S. Cl. ..... 36/44; 36/3 R
(58) Field of Search ..... 36/3 R, 3 B, 43, 36/44, 71

(56) References Cited

U.S. PATENT DOCUMENTS

| | | | | |
|---|---|---|---|---|
| 3,418,731 | | 12/1968 | Anciaux . | |
| 3,426,455 | | 2/1969 | Drago . | |
| 3,624,930 | | 12/1971 | Johnson et al. . | |
| 3,825,017 | | 7/1974 | Scrima . | |
| 4,054,706 | | 10/1977 | Shapiro . | |
| 4,170,078 | | 10/1979 | Moss . | |
| 4,185,402 | | 1/1980 | Digate . | |
| 4,285,144 | | 8/1981 | Power . | |
| 4,336,661 | | 6/1982 | Medrano . | |
| 4,413,429 | | 11/1983 | Power . | |
| 4,461,099 | | 7/1984 | Bailly . | |
| 4,513,518 | | 4/1985 | Jalbert et al. . | |
| 4,619,055 | | 10/1986 | Davidson . | |
| 4,627,179 | | 12/1986 | McElroy . | |
| 4,633,598 | | 1/1987 | Moronaga et al. . | |
| 4,642,912 | | 2/1987 | Wildman et al. . | |
| 4,674,204 | | 6/1987 | Sullivan et al. . | |
| 4,677,766 | | 7/1987 | Gudas . | |
| 4,685,224 | * | 8/1987 | Anger | 36/44 |
| 4,823,483 | | 4/1989 | Chapnick . | |
| 4,896,441 | | 1/1990 | Galasso . | |
| 5,068,983 | | 12/1991 | Marc . | |
| 5,216,825 | * | 6/1993 | Brum | 36/44 |
| 5,551,173 | | 9/1996 | Chambers . | |
| 5,675,914 | | 10/1997 | Cintron . | |
| 5,718,064 | | 2/1998 | Pyle | 36/44 |
| 5,845,418 | | 12/1998 | Chi . | |

* cited by examiner

*Primary Examiner*—M. D. Patterson
(74) *Attorney, Agent, or Firm*—Senniger, Powers, Leavitt & Roedel

(57) ABSTRACT

A laminated foam sockliner for use in combination with footwear to cushion a foot inserted in the footwear. The sockliner comprises a compressibly resilient closed cell foam lower layer having top and bottom surfaces sized and shaped for insertion into the footwear and for supporting at least a portion of the foot. The lower layer has a compressibility sufficient to permit the layer to resiliently compress under the foot in response to pressure applied to the layer by the foot during periods of a gait cycle when the footwear impacts the ground thereby absorbing shock and cushioning the foot during impact. The sockliner further comprises an open cell foam upper layer having top and bottom surfaces sized and shaped for insertion in the footwear. The bottom surface of the upper layer is permanently bonded to the top surface of the lower layer for spacing the lower layer from the foot to reduce heat transfer from the lower layer to the foot and insulate the foot from thermal energy generated by the lower layer in response to compression of the lower layer by the foot during the gait cycle. In another aspect, the sockliner includes a compressibly resilient closed cell foam lower layer and a porous upper layer. The upper layer has a plurality of openings extending upward from a bottom surface aligned with openings extending through the lower layer for permitting air to pass through the upper and lower layers to cool and dry the foot.

5 Claims, 3 Drawing Sheets

SOCKLINER

BACKGROUND OF THE INVENTION

The present invention relates generally to a sockliner and more particularly to a sockliner which cushions a foot while preserving a cool and dry environment for the foot.

When walking and running, various portions of the foot impact the ground at different times during the gait cycle. Generally, an outside (i.e., lateral) portion of the heel strikes the ground first, and the foot pivots on the heel to bring the outside portion of the forefoot into contact with the ground. From this position, the foot rapidly rotates inwardly to a neutral position in which the bottom of the heel and the forefoot are in contact with the ground. Thus, certain parts of the foot are subjected to repeated impact forces during walking and running. Moreover, these impact forces transfer to related anatomical features such as the shins and knees. Over time, these forces can cause pain and injury to the structures and tissue of the feet and the related anatomical features.

Foam sockliners frequently are used in shoes to attenuate the impact forces applied to the feet by the ground during walking and running. In the past, these sockliners frequently were made of closed cell polyurethane foam which offered excellent shock attenuation properties and durability. However, when closed cell foam is compressed, it generates heat due to a phenomena known as hysteresis. Moreover, the closed cell foam does not breathe well because it is substantially impermeable to air. Thus, closed cell foam sockliners heat the foot and do not keep the foot dry.

SUMMARY OF THE INVENTION

Among the several objects and features of the present invention may be noted the provision of a sockliner which provides cushioning to attenuate impact without heating the foot and while permitting the foot to breathe; and the provision of a method of making sockliners which permits a closed cell foam to be molded adjacent an open cell foam without substantially adversely affecting the breathability of the sockliner.

Briefly, apparatus of this invention is a laminated foam sockliner for use in combination with footwear to cushion a foot inserted in the footwear. The sockliner comprises a compressibly resilient closed cell foam lower layer having top and bottom surfaces sized and shaped for insertion into the footwear and for supporting at least a portion of the foot. The lower layer has a compressibility sufficient to permit the layer to resiliently compress under the foot in response to pressure applied to the layer by the foot during periods of a gait cycle when the footwear impacts the ground thereby absorbing shock and cushioning the foot during impact. The sockliner further comprises an open cell foam upper layer having top and bottom surfaces sized and shaped for insertion in the footwear. The bottom surface of the upper layer is permanently bonded to the top surface of the lower layer for spacing the lower layer from the foot to reduce heat transfer from the lower layer to the foot and insulate the foot from thermal energy generated by the lower layer in response to compression of the lower layer by the foot during the gait cycle.

In another aspect of the invention, the sockliner comprises a compressibly resilient closed cell foam lower layer and a porous upper layer fashioned from a flexible material which is permeable to air having top and bottom surfaces sized and shaped for insertion in the footwear. The bottom surface of the upper layer is permanently bonded to the top surface of the lower layer. The upper layer has a plurality of openings extending upward from the bottom surface aligned with the openings extending through the lower layer for permitting air to pass through the upper and lower layers to cool and dry the foot.

In yet another aspect, the present invention is a method of manufacturing a sockliner for use in combination with footwear to cushion a foot inserted in the footwear. The method comprises the step of continuously applying a porous adhesive substance to at least one of a bottom surface of a cloth layer and a top surface of an open cell foam upper layer. Further, the method includes the steps of marrying the cloth layer and the upper layer to permanently bond the upper layer and the cloth layer, cutting the cloth layer and the upper layer to a size and shape for insertion into the footwear and for supporting at least a portion of the foot, and compression molding the bonded upper layer and the cloth layer in a first mold to partially close exposed open cells in a bottom surface of the upper layer. The method also includes the steps of removing the compression molded upper layer and the cloth layer from said first mold, and inserting the compression molded upper layer and the cloth layer into a second mold. In addition, the method comprises the step of pouring a polyurethane onto the bottom surface of the upper layer in the second mold. Still further, the method includes the steps of foaming the polyurethane to form a closed cell foam lower layer adjacent the upper layer, and removing the cloth layer, the upper layer and the lower layer from the second mold.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
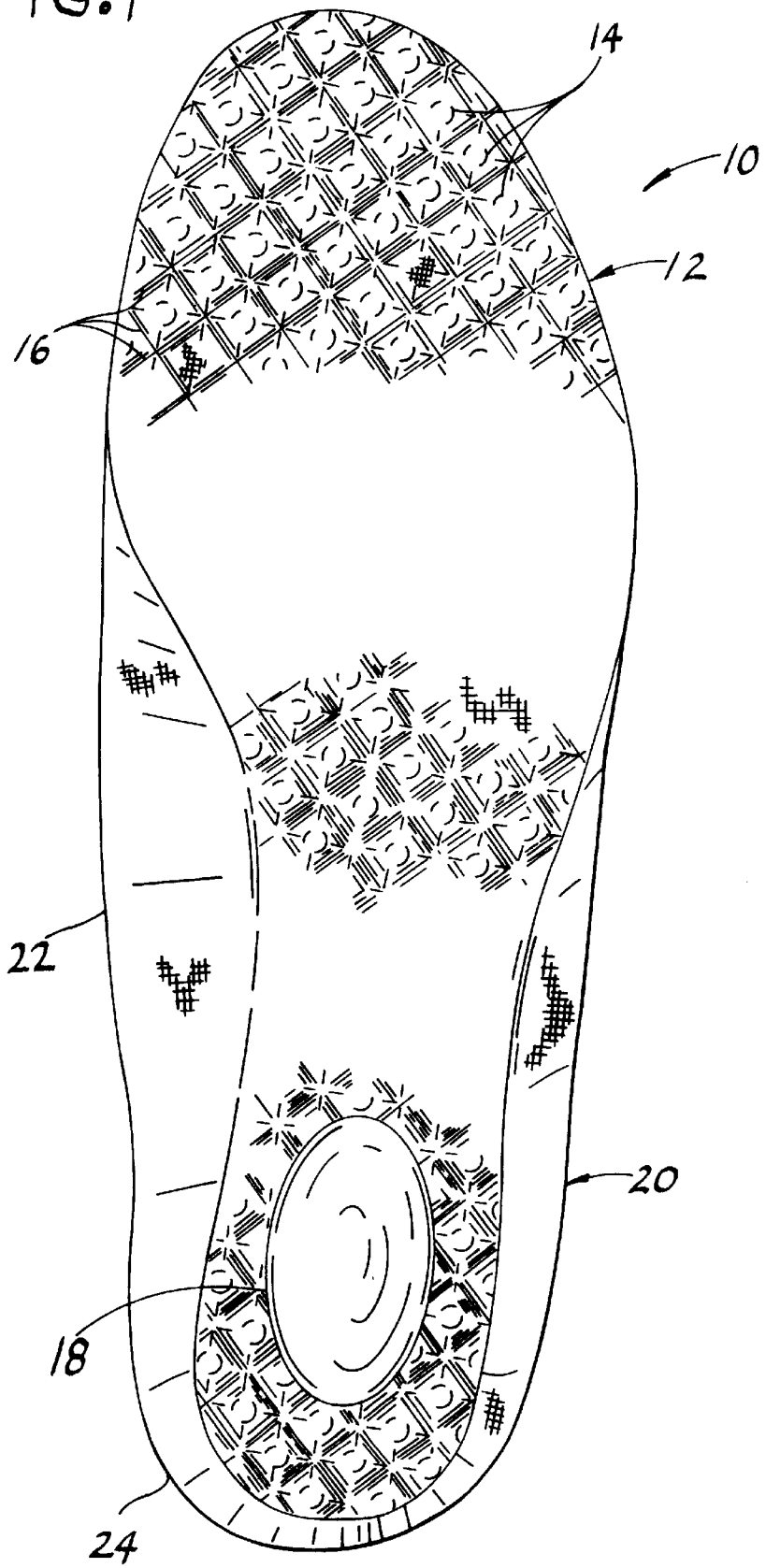
FIG. 1 is a top plan of a sockliner of the present invention.

Referring now to the drawings and in particular to FIG. 1, a sockliner or inner sole is designated in its entirety by the reference number 10. The sockliner 10 is sized and shaped for insertion in footwear (not shown) over a sole of the footwear to attenuate shock to a foot during running and walking. Although the sockliner 10 of the preferred embodiment is sized and shaped to underlie the entire area of a foot, other sizes and shapes may be used without departing from the scope of the present invention. For instance, it is envisioned that the sockliner may be a three-quarter length sockliner sized for extending from the heel of a foot to a position just in front of the metatarsal heads.

As illustrated in FIG. 1, the sockliner 10 includes an upper surface, generally designated by 12, having a field of generally truncated pyramid-shaped protrusions 14. Grooves 16 formed between the protrusions 14 permit air circulation under the foot to keep the foot cool and dry. A raised pillow formation 18 is provided at the rearward end of the upper surface 12 for cushioning the heel during initial impact of the foot against the ground. The formation 18 also provides a smooth surface without protrusions for displaying a trademark or other indicia regarding the sockliner 10. A wall, generally designated by 20, extends around a rearward end of the sockliner 10 and forms an arch support 22 for supporting the arch of a foot and a heel cup 24 for positioning the heel of a foot on the sockliner.

Figure 2:
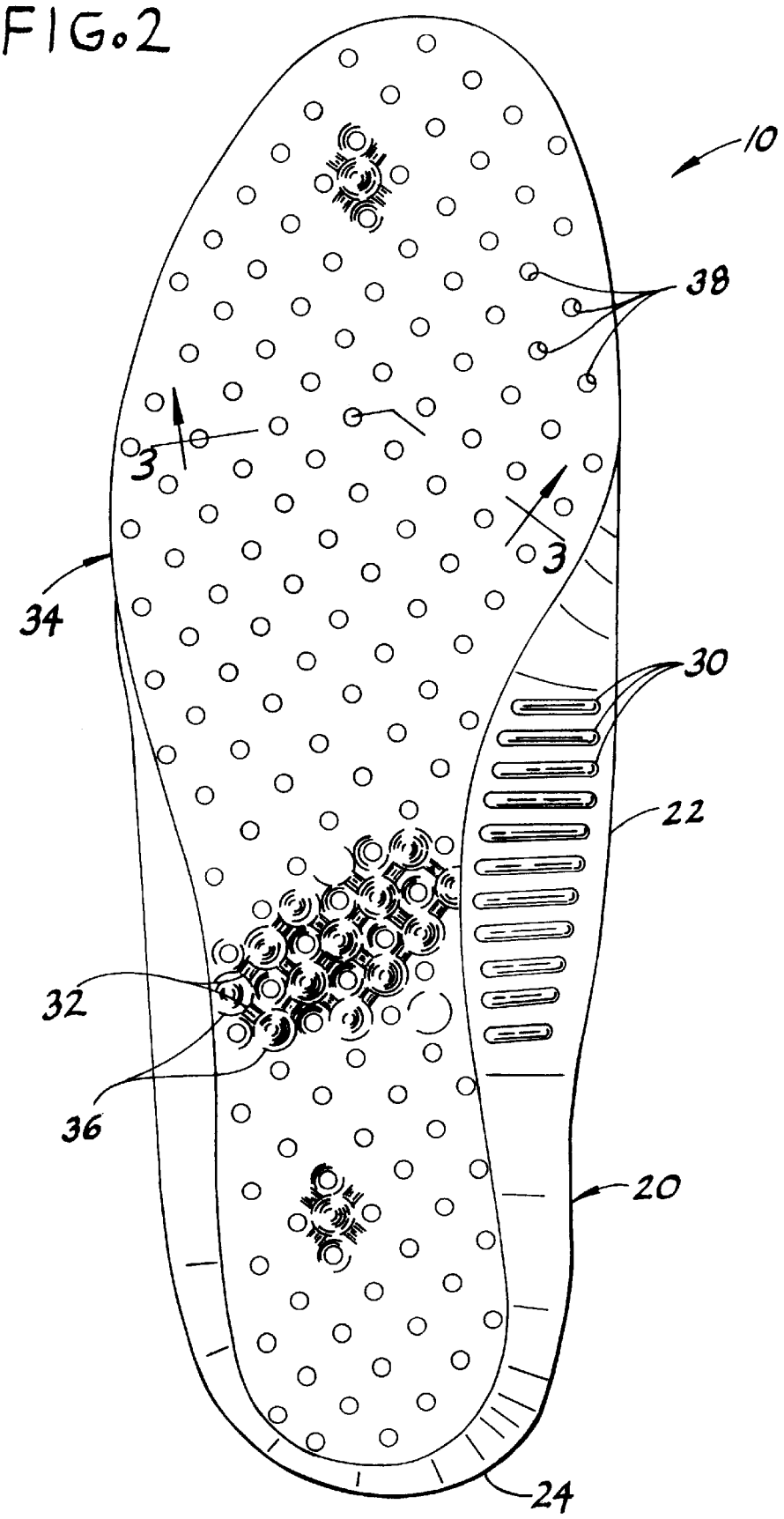
FIG. 2 is a bottom plan of the sockliner.
Figure 3:
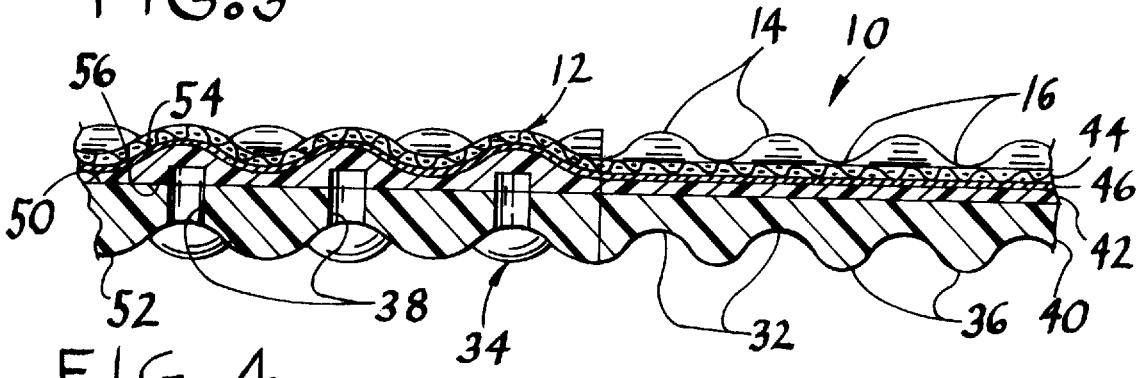
FIG. 3 is a cross section of the sockliner taken in the plane of line 3—3 of FIG. 1.

As shown in FIG. 2, a series of ribs 30 extends under the arch support 22 for stiffening the support. As illustrated in FIG. 3, a plurality of channels 32 arranged in an evenly spaced rectilinear grid extends across a lower surface, generally designated by 34, of the sockliner 10 for permitting air circulation under the sockliner. The sockliner 10 rests on the sole of the footwear on a matrix of rounded projections 36 positioned between the channels 32. Openings 38 extend upward into the sockliner 10 between the projections 36 at evenly spaced intervals along the rectilinear grid of channels 32 for permitting air to flow through the sockliner 10 from the channels 32. The openings 38 permit air to pass through the closed cell foam of the lower layer 40 to cool and dry the foot. The channels 32 extend between the openings 38 and the edges of the sockliner 10 for permitting air to flow under the sockliner and through the openings when the lower surface 34 contacts the sole of the footwear.

As further illustrated in FIG. 3, the sockliner 10 is a laminated structure comprising a compressibly resilient closed cell foam lower layer 40, an open cell foam upper layer 42, and a cloth layer 44 permanently bonded to the upper layer with an adhesive substance 46. The lower layer 40 has top and bottom surfaces 50, 52, respectively, sized and shaped for insertion into the footwear and for supporting at least a portion of the foot. Further, the lower layer 40 has a compressibility sufficient to permit the layer to resiliently compress under the foot in response to pressure applied to the layer by the foot during periods of a gait cycle when the footwear impacts the ground to absorb shock and cushion the foot during impact. The upper layer 42 has top and bottom surfaces 54, 56, respectively, sized and shaped for insertion in the footwear. The bottom surface 56 of the upper layer 42 is permanently bonded to the top surface 50 of the lower layer 40 by a process which will be explained in detail below. The upper layer 42 is fashioned from a flexible material which is porous and permeable to air.

As will be understood by those skilled in the art, although the lower layer 40 has good cushioning properties, it generates heat from repeated compression during walking and running. The upper layer 42 spaces the lower layer 40 from the foot to reduce heat transfer from the lower layer to the foot and insulate the foot from thermal energy generated by the lower layer. The openings 38 extend in a straight line through both the upper layer 42 and the lower layer 40 for permitting air to pass through the upper and lower layers to cool and dry the foot. Although the lower layer 40 is impermeable to air, the openings 38 extending upward through the lower layer 40 permit air to pass through the lower layer to the upper layer 42. Because the upper layer 42 is permeable to air, air traveling through the openings 38 flows through the upper layer of the sockliner 10 to cool and dry the foot.

Although the upper and lower layers 42, 40 may be made of other materials without departing from the scope of the invention, the upper and lower layers of the preferred embodiment used in general purpose athletic shoes are made of polyurethane. The upper layer 42 is a breathable, open cell foam having a specific gravity of between about 0.15 and 0.20, and a Shore C scale durometer hardness of between about 17 and about 23. The lower layer 40 is a closed cell foam having a specific gravity of between about 0.25 and 0.32, and a Shore C scale durometer hardness of between about 22 and about 28. However, materials having other properties may be used to maximize comfort and cushioning in footwear intended for other purposes. For instance, sockliners for men's basketball footwear may have higher specific gravities and hardnesses due to increased body weight and jumping activity.

The cloth layer 44 is sized and shaped in correspondence with the upper and lower layers 42, 40, respectively. The cloth layer 44 is permanently bonded to the top surface 54 of the upper layer 42 by a porous adhesive substance 46 applied between the upper layer and the cloth layer. In the most preferred embodiment, the adhesive substance 46 is applied to either the cloth layer or the upper layer in a continuous layer. Because the adhesive substance 46 is porous, air can pass through the adhesive layer and flow substantially unimpeded between the upper layer 42 and the cloth layer 44. Although other adhesive substances may be used without departing from the scope of the present invention, the adhesive substance 46 of the preferred embodiment is a polyurethane cement. Although other materials may used as the cloth layer 44 without departing from the scope of the present invention, the cloth layer of the preferred embodiment is a conventional sockliner covering such as a brushed nylon fabric.

Figure 4:
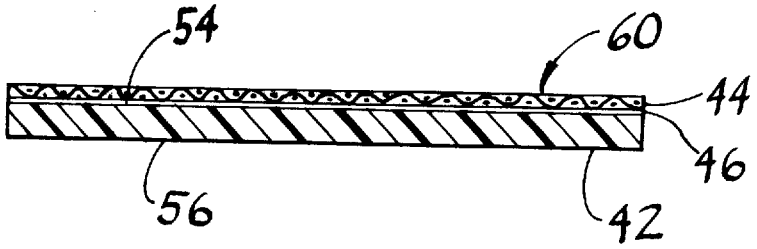
FIG. 4 is a schematic cross section of a cloth layer bonded to an upper foam layer.
Figure 5:
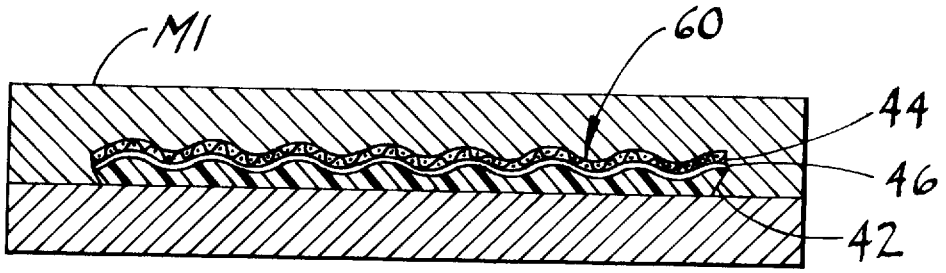
FIG. 5 is a schematic cross section of the cloth layer and upper foam layer during compression molding.
Figure 6:
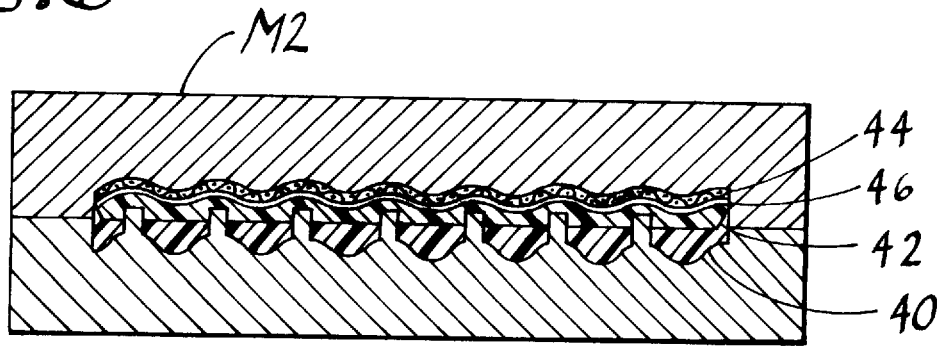
FIG. 6 is a schematic cross section of a foam bottom layer being molded on the cloth layer and upper layer.

FIGS. 4–6 illustrate a method of making the sockliner 10 of the present invention. As shown in FIG. 4, an upper subassembly, generally designated by 60, is formed by adhesively bonding a sheet of cloth 44 to a sheet of porous, open cell polyurethane foam 44 using an adhesive substance 46. The cloth 44 is bonded to the foam 44 by spraying or otherwise applying an adhesive substance on either the cloth or the foam sheet before marrying the sheets. Although sheets having other thicknesses may be used without departing from the scope of the present invention, the cloth of the preferred embodiment is between about 0.4 millimeters (mm) and about 0.6 mm thick and the open cell foam of the preferred embodiment is between about 3.0 mm and about 3.5 mm thick, resulting in a total thickness for the subassembly 60 of between about 3.4 mm and about 4.1 mm.

The subassembly 60 is cut to a desired size and shape before being placed in a first mold M1 as shown in FIG. 5 for compression molding. The first mold M1 is heated to a temperature of about 120 degrees centigrade and closed on the subassembly 66 for about one minute. The nominal height of the mold cavity is about 85 percent of the total thickness of the subassembly 66 so the mold M1 squeezes the subassembly when the mold is closed. Due to the heat and pressure applied by the mold M1, the subassembly 66 is permanently molded to the shape of the mold cavity. Further, the bottom surface 56 of the upper layer 42 is partially sealed (i.e, the exposed open cells are closed) by the heat and pressure so liquid cannot pass through the bottom surface but air freely passes through the surface. As shown in FIG. 5, the compression molding process also forms the truncated pyramid-shaped protrusions 14.

Once the subassembly 66 is compression molded, it is removed from the first mold M1 and loaded into an upper half of a second mold M2. The second mold 2 is heated to about 45 degrees centigrade and a foaming liquid polyurethane is poured into the second mold M2. The mold M2 is closed so the subassembly 60 is positioned above the liquid polyurethane, and the mold is held at a temperature of about 45 degrees centigrade for about ten minutes to cure the polyurethane. As the liquid polyurethane cures, it expands to form the lower layer 40 of the sockliner 10. The lower layer 40 permanently bonds to the upper layer 42 during the curing process. After the lower layer 40 cures, the finished sockliner 10 is removed from the second mold M2.

Sockliners 10 made by this process have good cushioning properties for attenuating shock to feet during running and walking. In addition, because the upper foam layer 42 spaces the closed cell foam layer 40 from the foot, less heat is transferred to the foot from closed cell layer. Moreover, the grooves 16 and channels 32 formed in the upper and lower surfaces 12, 34, respectively, permit air to flow between the foot and the sockliner 10 and between the sole of the footwear and the sockliner. The openings 38 in the lower layer 40, the porosity of the adhesive substance 46, and the porosity of the upper layer 42 permit the air to flow vertically between the grooves 16 and the channels 32 to cool the foot and keep it dry. Further, the porosity of the open cell foam helps to defuse the air traveling through the sockliner 10 to deliver air to the entire surface of the sole of the foot rather than in localized areas corresponding to the openings 38. Moreover, because the sockliner 10 uses closed cell foam in the lower layer 40, the sockliner has high durability and tear strength.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A laminated foam sockliner for use in combination with footwear to cushion a foot inserted in the footwear, the sockliner comprising:

a compressibly resilient closed cell foam lower layer having top and bottom surfaces sized and shaped for insertion into the footwear and for supporting at least a portion of the foot, said lower layer having a compressibility sufficient to permit said layer to resiliently compress under the foot in response to pressure applied to said layer by the foot during periods of a gait cycle when the footwear impacts the ground thereby absorbing shock and cushioning the foot during impact, the lower layer having a plurality of openings extending from the top surface to the bottom surface for permitting air to pass through said lower layer; and a porous upper layer fashioned from a flexible material which is permeable to air having top and bottom surfaces sized and shaped for insertion in the footwear, the bottom surface of the upper layer being permanently bonded to the top surface of the lower layer, the upper layer having a plurality of openings extending upward from the bottom surface only partially through the upper layer, and aligned with the openings extending through the lower layer for permitting air to pass through the lower layer and to diffuse through the upper layer to cool and dry the foot.

2. A sockliner as set forth in claim 1 wherein the bottom surface of the lower layer has at least one channel extending between the plurality of openings and an edge of the sockliner for permitting air to flow under the sockliner and through the openings to cool and dry the foot.

3. A sockliner as set forth in claim 1 wherein the porous upper layer comprises an open cell foam layer, and the sockliner further comprises a cloth layer sized and shaped in correspondence with said upper and lower layers, permanently bonded to the top surface of the upper layer by a porous adhesive substance continuously applied between the upper layer and the cloth layer.

4. A sockliner as set forth in claim 1 wherein the bottom surface of the lower layer has at least one channel extending between the plurality of openings and an edge of the sockliner for permitting air to flow under the sockliner in the channels from the edge and through the openings to cool and dry the foot when the lower layer is in contact with the footwear.

5. A sockliner as set forth in claim 4 wherein said at least one channel comprises a plurality of channels arranged in a grid extending across the bottom surface of the lower layer, and interconnecting the plurality of openings.

* * * * *